US006946593B2

(12) United States Patent
Goodman et al.

(10) Patent No.: US 6,946,593 B2
(45) Date of Patent: Sep. 20, 2005

(54) MOUTHPIECE COVER FOR BRASS INSTRUMENTS

(76) Inventors: Jeannette Goodman, 197 Mulligan Dr., Hollidaysburg, PA (US) 16648; Donald M. Goodman, 197 Mulligan Dr., Hollidaysburg, PA (US) 16648

( * ) Notice: Subject to any disclaimer, the term of this patent is extended or adjusted under 35 U.S.C. 154(b) by 382 days.

(21) Appl. No.: 10/320,579

(22) Filed: Dec. 17, 2002

(65) Prior Publication Data

US 2004/0112198 A1 Jun. 17, 2004

(51) Int. Cl.[7] ..... G10D 9/02
(52) U.S. Cl. ..... 84/398; 84/399
(58) Field of Search ..... 84/398, 399, 387 R, 84/387 A

(56) References Cited

U.S. PATENT DOCUMENTS 1,896,814 A * 2/1933 Gemeinhardt ..... 84/383 R
4,991,483 A 2/1991 Petit
5,920,022 A * 7/1999 Ashwood, Jr. ..... 84/453
D475,735 S * 6/2003 Louis ..... D17/99

* cited by examiner

*Primary Examiner*—Kimberly Lockett
(74) *Attorney, Agent, or Firm*—Richard C. Litman

(57) ABSTRACT

A protective cover for the mouthpiece of brass instruments is formed by three portions. The first cover portion is in the form of a molded tube or cylinder. The tube is sized to snugly fit over the cup of the mouthpiece and a part of the instrument shaft adjacent the cup of the mouthpiece. The second cover portion is a cup formed from a second tube or cylinder having one closed end. The cup is sized to be snugly mounted over the rim of the mouthpiece and an adjacent part of the first cover portion covering the cup of the mouthpiece. The first and second portions are molded from an elastomeric thermal insulating foam material and covered with a stretchable nylon shell. The third portion is in the form of an elastic band connected at one end to the first portion and at a second end to the second portion. The elastic band acts as a tether for the second portion when the second portion is removed for playing the brass instrument.

16 Claims, 2 Drawing Sheets

MOUTHPIECE COVER FOR BRASS INSTRUMENTS

BACKGROUND OF THE INVENTION

1. Field of the Invention

The present invention generally relates to covers for the mouthpieces of musical instruments and more specifically relates to a thermally insulating cover for the mouthpiece of a brass instrument.

2. Description of the Related Art

A frequent problem with brass instruments is keeping the mouthpiece of the instrument warm and dry in cold and wet weather conditions. Brass instruments are difficult to play when conditions are cold or wet.

Covers for the mouthpieces of instruments are known in the prior art and may take many forms, for example, U.S. Pat. No. 4,991,483 issued Feb. 12, 1991 to Petit teaches a mouthpiece for a wind instrument, and corresponding ligature and mouthpiece cover. The mouthpiece cover is designed to protect the mouthpiece from contact or injury and prevents deformation of the reed by the use of a spring device which presses the reed toward the chamber opening of the mouthpiece.

None of the prior art instrument mouthpiece covers, taken either singularly or in combination, is seen to describe the instant invention as claimed. Thus a thermally insulating protective cover for the mouthpiece of brass instruments solving the aforementioned problems is desired.

SUMMARY OF THE INVENTION

The present invention provides a protective cover for mouthpieces of brass instruments. The cover comprises three cooperating portions. The first portion is in the form of a tube. The tube is sized to snugly fit over the cup of a brass instrument mouthpiece and a portion of the instrument shaft adjacent the cup. The second portion is a cup formed from a second tube or cylinder having one closed end. The second portion is sized to snugly receive the rim and an adjacent part of the first portion covering the cup on the mouthpiece. The first and second portions are molded from a thermally insulating elastomeric foam material and covered with a stretchable nylon shell.

An elastic band forms the third portion of the cover. The elastic band is connected at one end to the first portion and at a second end to the second portion. The elastic band acts as a tether for the second portion when the second portion is removed for playing the brass instrument.

Accordingly, it is the principal object of the invention to provide a thermally insulating protective cover for the mouthpieces of brass instruments.

It is another object of the invention to provide a mouthpiece cover for brass instruments that protects the mouthpiece from moisture or precipitation in the air.

It is a further object of the invention to provide a mouthpiece cover for brass instruments that protects the mouthpiece from direct exposure to cold and/or moisture laden air.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
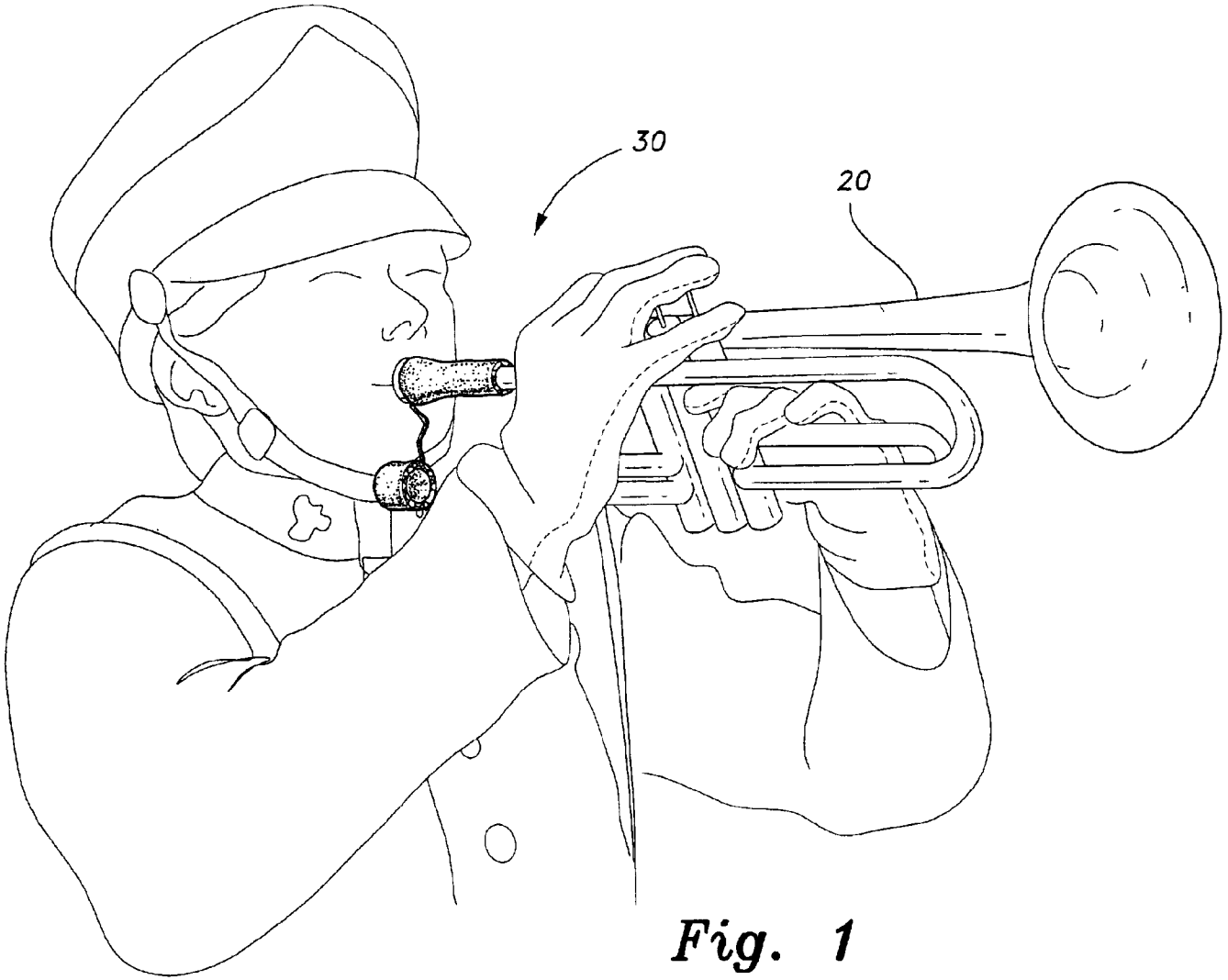
FIG. 1 is an environmental, perspective view of a mouthpiece cover for a brass instrument according to the present invention.
Figure 2:
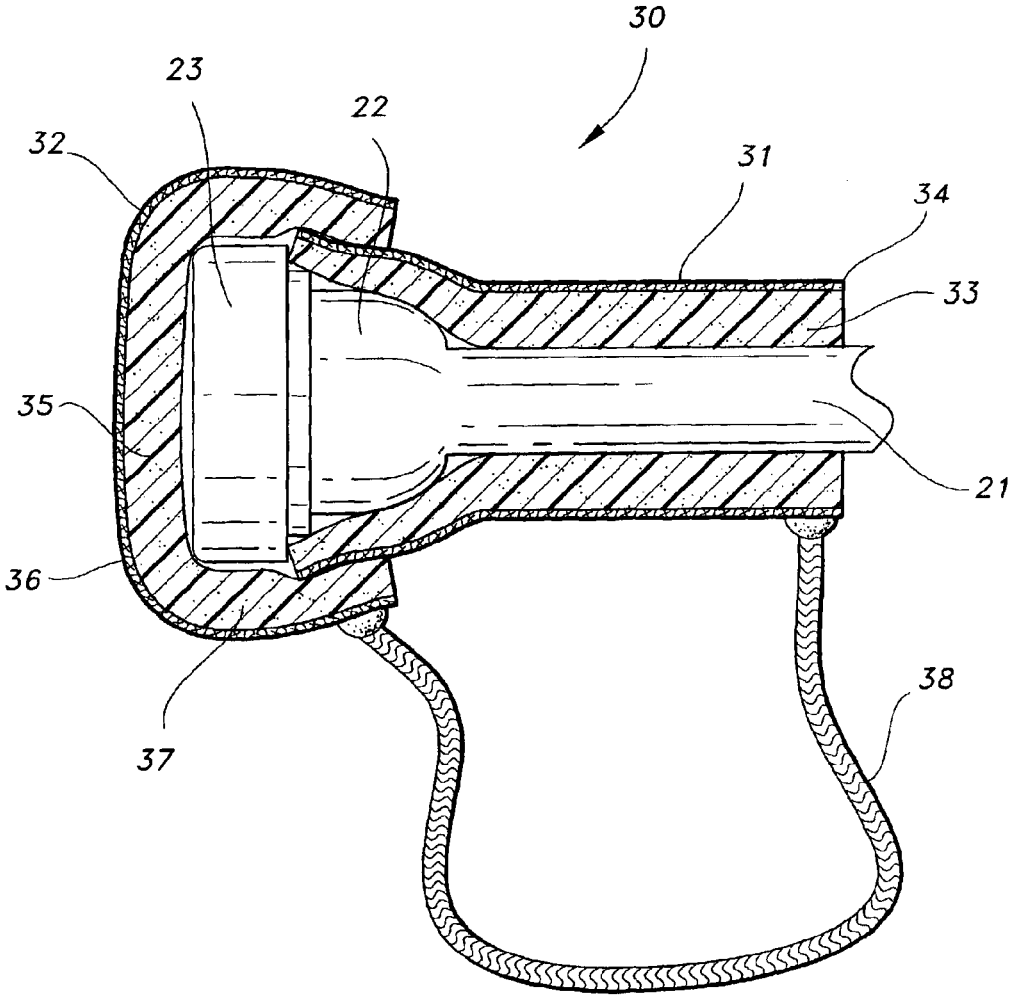
FIG. 2 is a cross-sectional view of the mouthpiece cover attached to the mouthpiece of a brass instrument.

The present invention is a protective cover 30 for the mouthpieces of brass instrument. The cover 30 comprises three cooperating portions.

The first portion 31 is in the form of a tube or cylinder 33 that has been molded from a heat insulating elastomeric foam material. The outer surface of the tube includes a stretchable nylon shell 34. The first portion 31 is sized to snugly fit over the cup 22 of a brass instrument mouthpiece and a portion of the instrument shaft 21 adjacent the cup 22 of the mouthpiece.

The second portion 32 is a cup formed from a second tube or cylinder 37 having one closed end 35 that is molded from a heat insulating elastomeric foam material. The outer surface of the second portion 32 is covered with a stretchable nylon shell 36 and sized to be snugly received about the rim 23 of the mouthpiece and an adjacent part of the first portion covering the cup 22 of the mouthpiece of the brass instrument.

The cover 30 allows heat to be retained longer in the mouthpiece in cold weather and prevents moisture in the air from being deposited on the lip engaging portion of the mouthpiece.

An elastic band 38 is the third portion of the cover. The elastic band 38 is connected at one end to the first portion and at a second end to the second portion. The elastic band acts as a tether for the second portion when the second portion is removed for playing the brass instrument.

A cover as described not only provides a protective thermal barrier around the mouthpieces of brass instruments to protect the mouthpiece from the cold and wet, but also protects the mouthpiece from injury and moisture or precipitation in the air. In addition, the stretchable nylon shell can be colored to match the colors of band uniforms.

It is to be understood that the present invention is not limited to the embodiment described above, but encompasses any and all embodiments within the scope of the following claims.

We claim:

1. A cover for a mouthpiece of brass instruments comprising:

a first cover portion in the form of a tube of thermal insulation sized to snugly fit around the cup of the instrument mouthpiece and a part of the instrument shaft adjacent the mouthpiece;

a second cover portion in the shape of a tube of thermal insulation, having one closed end, said second cover portion being sized to snugly fit around the rim of the mouthpiece and part of the first cover portion covering the cup of the mouthpiece; and an elongated elastic band connected at one end to said first cover portion and at a second end to said second cover portion.

2. The mouthpiece cover according to claim 1, wherein said first and second cover portions are formed from an insulating foam material.

3. The mouthpiece cover according to claim 1, wherein said first cover portion is in the form of a molded tube of insulating foam material.

4. The mouthpiece cover according to claim 3, wherein said second cover portion is in the form of molded insulating foam material.

5. The mouthpiece cover according to claim 1, further including a stretchable colored nylon shell affixed to the exterior surfaces of said first and second cover portions.

6. The mouthpiece cover according to claim 5, wherein said first and second cover portions are formed from an insulating foam material.

7. The mouthpiece cover according to claim 5, wherein said first cover portion is in the form of a molded tube of insulating foam material.

8. The mouthpiece cover according to claim 7, wherein said second cover portion is in the form of molded insulating foam material.

9. A protective cover for the mouthpiece of brass instruments comprising:

a first tubular thermal insulating cover portion sized to snugly fit around the part of an instrument shaft adjacent to mouthpiece and the cup of the mouthpiece;

a second cupshaped thermal insulating cover portion sized to snugly fit around the rim of the mouthpiece and an adjacent part of the first cover portion covering the cup of the mouthpiece; and an elongated elastic band connected at one end to said first cover portion and at a second end to said second cover portion.

10. The protective cover according to claim 9, wherein said first and second cover portions are formed from an elastomeric thermal-insulating foam material.

11. The protective cover according to claim 9, wherein said first cover portion is in the form of a molded tube of an elastomeric thermal-insulating foam material.

12. The protective cover cover according to claim 11, wherein said second cover portion is in the form of a molded cup of an elastomeric thermal-insulating foam material.

13. The protective cover according to claim 9, further including a stretchable colored nylon shell secured to the exterior surfaces of said first and second cover portions.

14. The protective cover according to claim 13, wherein said first and second cover portions are formed from an elastomeric thermal-insulating foam material.

15. The protective cover according to claim 13, wherein said first cover portion is in the form of a molded tube of an elastomeric thermal-insulating foam material.

16. The protective cover according to claim 15, wherein said second cover portion is in the form of a molded cup of an elastomeric thermal-insulating foam material.

* * * * *